US005842775A

United States Patent [19]

Roorda et al.

[11] Patent Number: 5,842,775

[45] Date of Patent: Dec. 1, 1998

[54] LOW PROFILE UNDER CABINET HALOGEN LIGHT BAR WITH HEAT SHIELD

[75] Inventors: John W. Roorda, La Jolla; Andrew H. Cramp, San Diego, both of Calif.

[73] Assignees: Westek Associates a California Partnership of Westek, Inc.; Sea Side Industries, Inc., both of San Diego, Calif.

[21] Appl. No.: 556,220

[22] Filed: Nov. 9, 1995

[51] Int. Cl.[6] ..... F21V 29/00

[52] U.S. Cl. ..... 362/294; 362/133; 362/147; 362/373; 362/374; 362/394

[58] Field of Search ..... 362/294, 133, 362/147, 373, 374, 394, 376, 263, 264

[56] References Cited

U.S. PATENT DOCUMENTS

| | | | |
|---|---|---|---|
| D. 359,374 | 6/1995 | Weinstock | D26/80 |
| 2,784,302 | 3/1957 | Golden | 362/133 |
| 3,081,397 | 3/1963 | Tantillo et al. | 362/133 |
| 3,808,495 | 4/1974 | Win | 313/110 |
| 4,415,967 | 11/1983 | Schwartz | 362/297 |
| 4,646,210 | 2/1987 | Skogler et al. | 362/142 |
| 4,733,336 | 3/1988 | Skogler et al. | 362/142 |
| 4,780,799 | 10/1988 | Groh | 362/294 |
| 4,807,096 | 2/1989 | Skogler et al. | 362/142 |
| 4,816,969 | 3/1989 | Miller | 362/130 |
| 4,851,973 | 7/1989 | Layne | 362/147 |
| 4,998,188 | 3/1991 | Degelmann | 362/147 |
| 5,426,572 | 6/1995 | Weinstock et al. | 362/133 |

OTHER PUBLICATIONS

Ace Momentum Co., Ltd., Low Voltage Light Bars, Model No. BA 2, BA 2A, BA 3 and BA 3A, one page (undated).

TRULITE by Similights, one page product brochure dated 1993.

Lincs Fluorescent Light Fixture by Alkco, one page product brochure (undated).

Under Cabinet Lighting System by Tresco, one page product brochure (undated).

Lampi Fluorescent Light Fixture, one page product brochure (undated).

Eclairage AXIS Lighting, one page product brochure (undated).

*Primary Examiner*—Ira S. Lazarus
*Assistant Examiner*—David Lee
*Attorney, Agent, or Firm*—Brown Martin Haller & McClain

[57] ABSTRACT

A U-shaped plastic heat shield is mounted over a control surface region of the metal cover of a halogen light fixture. A manually actuable rocker switch mounted in the cover extends through a switch aperture in the heat shield for turning a halogen lamp assembly ON and OFF, and for dimming the same. The heat shield is sized and configured so that a user's finger tips will not directly contact the metal cover when the switch is actuated. The heat shield is removably attached to the cover with the same bolt and nut that hold the cover to the metal backing plate of the light fixture. The heat shield reduces the amount of heat otherwise felt by the user when manually actuating the switch.

11 Claims, 3 Drawing Sheets

LOW PROFILE UNDER CABINET HALOGEN LIGHT BAR WITH HEAT SHIELD

BACKGROUND OF THE INVENTION

The present invention relates generally to light fixtures, and more particularly, to an under cabinet halogen light fixture configured in the form of a relatively thin narrow bar adapted to be mounted on a downwardly facing surface of a cabinet and equipped with a heat shield around a manually actuable switch.

In recent years, low wattage accent lighting has become popular in home decorating. In one form of this accent lighting, strings of low voltage incandescent lights have been mounted beneath kitchen cabinets. More recently, low profile light bars incorporating small halogen lamps have become popular. These light fixtures typically include a stamped metal backing plate which is secured with screws to the underside of the cabinet and a removable stamped metal cover which encloses one or more halogen lamp assemblies, a transformer, lenses and a switch. See for example U.S. Pat. No. 5,426,572 granted Jun. 20, 1995 to Steven P. Weinstock, et al.

It is important that accent light fixtures of this general type have a very low profile so that they will be concealed from view when mounted to the downwardly facing surface of a cabinet. While halogen lamps are desirable because of their high level of brightness and their lighting pattern, they radiate a significant amount of heat. This becomes a problem inside of a small light fixture which has a metal backing plate and metal cover. In order for such light fixtures to be successfully commercialized in the United States they must be approved by Underwriters Laboratories (UL). The applicable standard requires that the temperature on the mounting surfaces, which are typically mounting pads formed on the metal back plate, not exceed ninety degrees C. In addition, the applicable UL standard for such light fixtures requires that the temperature on the user accessible surfaces around any manually actuated control not exceed sixty degrees C.

Even if a small light fixture is constructed to meet the aforementioned UL standard for user accessible control surface temperature, there is frequently still a problem with perceived heat. If the control surface temperature seems too warm to a user, he or she may get the undesirable impression that the fixture is overheating or wasting energy.

The present invention is directed to solving the problem of reducing the temperature of user accessible control surfaces.

SUMMARY OF THE INVENTION

In accordance with my invention, a light fixture comprises a metal housing, at least one halogen lamp assembly mounted inside the housing and a manually actuable switch mounted on the housing for controlling the lamp assembly. The housing includes a metal backing plate and a metal cover removably secured to the backing plate. The halogen lamp assembly is mounted in an interior of the housing for providing light through a first aperture in the metal cover while at the same time radiating a significant amount of heat that is absorbed by the metal cover. The manually actuable switch is mounted in a second aperture in the metal cover and is connected to the lamp assembly for controlling the energization thereof. A heat shield made of a material having a relatively low thermal conductivity is located in an operative position overlying a control surface region of the metal cover surrounding the second aperture. The heat shield is sized and configured so that a user's fingers will not directly contact the metal cover when the switch is actuated. A mechanism is provided for attaching the heat shield to the metal cover in the operative position. The heat shield reduces the amount of heat otherwise felt by the user when manually actuating the switch.

DETAILED DESCRIPTION OF THE PREFERRED EMBODIMENTS

Figure 1:
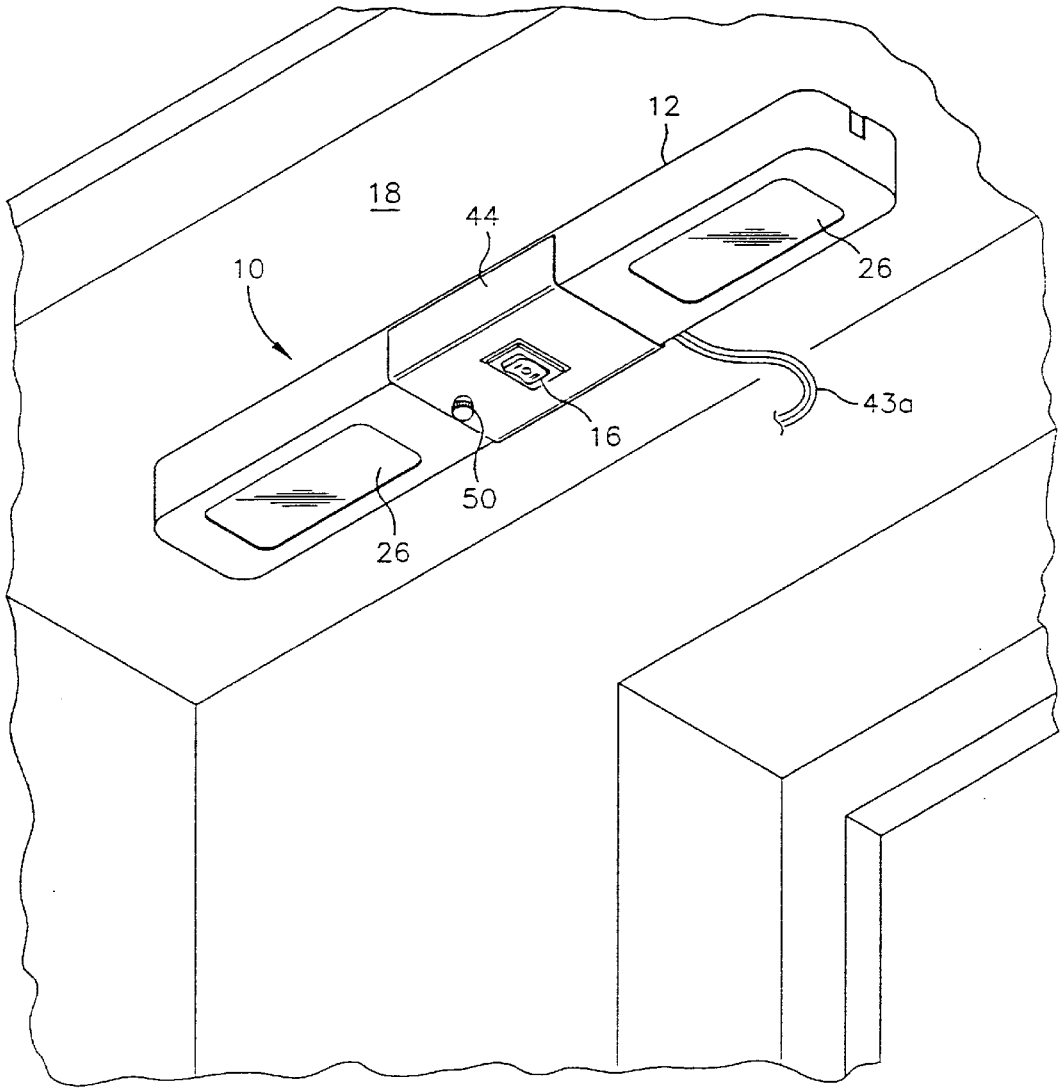
FIG. 1 is a perspective view of a low profile halogen light bar mounted to the underside of a cabinet next to a window. The light bar is equipped with a heat shield surrounding its manually actuable rocker switch in accordance with a first embodiment of the present invention.
Figure 2:
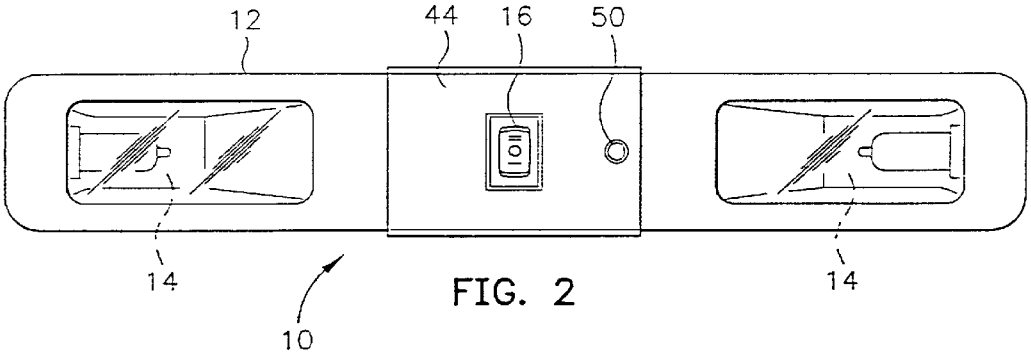
FIG. 2 is an enlarged top plan view of the light bar of FIG. 1.

In accordance with my invention a light fixture 10 comprises a generally rectangular metal housing 12 (FIG. 1), a pair of halogen lamp assemblies 14 (FIG. 2) mounted inside the housing and a manually actuable rocker switch 16 (FIG. 2) mounted to the housing 12 for controlling the energization of the lamp assemblies 14. The housing 12 (FIG. 1) has an elongated, thin low profile shape so that it will not be visible when mounted to the underside of a wooden kitchen cabinet 18. The lamp assemblies 14 point downwardly and thus provide accent illumination on the countertop (not illustrated) below the cabinet 18. The housing 12 is made of stamped sheet metal and includes a metal backing plate 20 (FIGS. 3 and 4) and a metal cover 22 (FIG. 3) removably secured to the backing plate 20. A screw (not illustrated) extends through a key hole 23 (FIG. 4) in the backing plate 20 for securing the light fixture 10 to the underside of the cabinet 18.

The halogen lamp assemblies 14 (FIG. 3) are mounted in an interior of the metal housing 12 for providing light through apertures 24 in the metal cover 22. The metal backing plate 20 is formed with four mounting pads or protrusions 25 (FIG. 4) which contact the underside of the cabinet 18. Clear or frosted diffusing lenses 26 (FIG. 3) are releasably held in position over the apertures 24 by spring-action metal clips 28.

Figure 3:
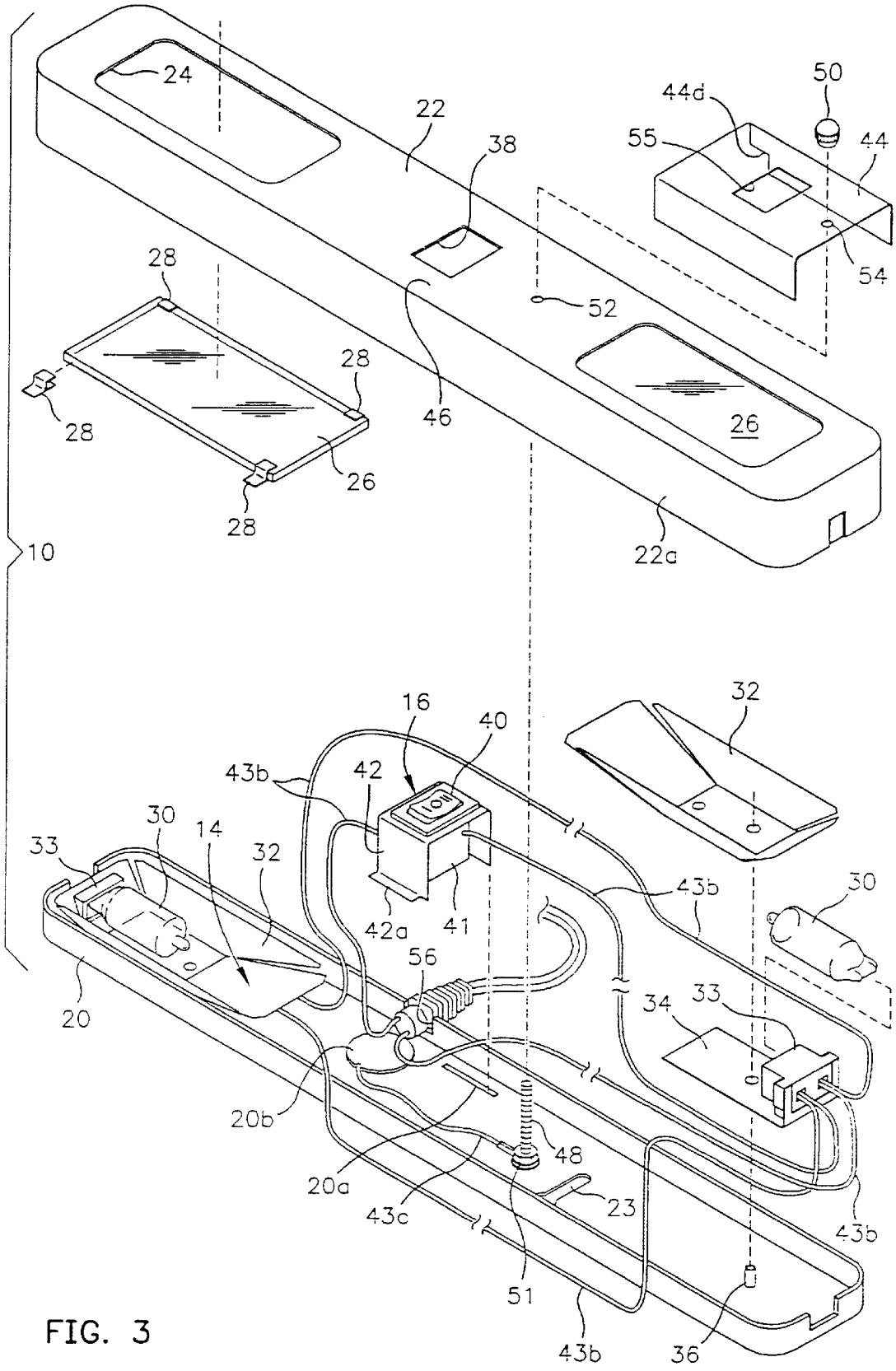
FIG. 3 is an enlarged exploded perspective view of the light bar of FIG. 1.
Figure 4:
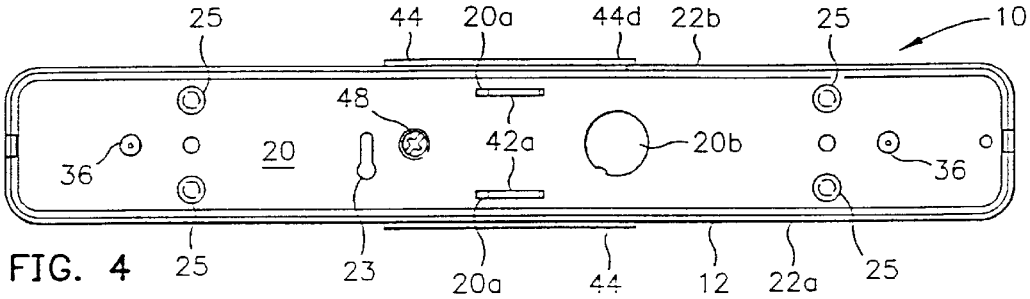
FIG. 4 is an enlarged bottom plan view of the light bar of FIG. 1.
Figure 5:
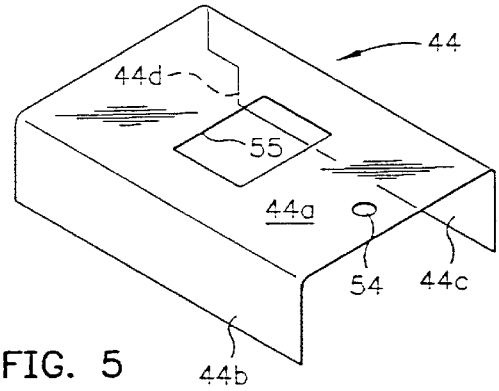
FIG. 5 is a greatly enlarged perspective view of the heat shield of the light bar of FIG. 1.
Figure 6:
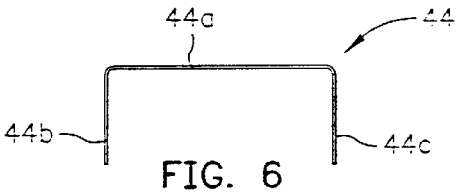
FIG. 6 is an end elevation view of the heat shield of FIG. 5.
Figure 7:
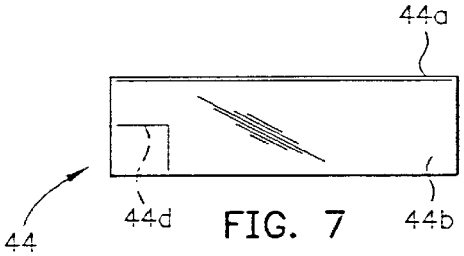
FIG. 7 is a side elevation view of the heat shield of FIG. 5.
Figure 8:
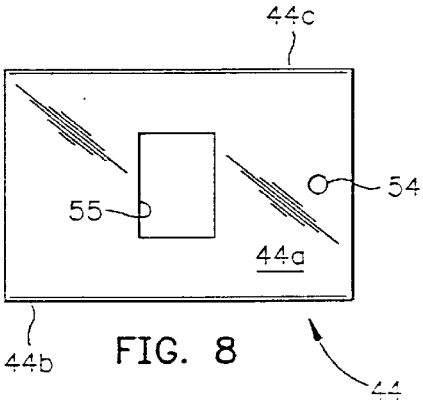
FIG. 8 is a top plan view of the heat shield of FIG. 5.

The two lamp assemblies 14 (FIG. 2) include corresponding halogen bulbs 30 (FIG. 3) that are preferably designed with special filaments that permit them to operate on 120 volt AC line power, without the necessity of utilizing a transformer. The bulbs 30 radiate a significant amount of heat that is absorbed by the metal cover 22 (FIG. 3). The lamp assemblies 14 also include folded metal reflectors 32 (FIG. 3) which are secured to the metal backing plate 20 and plastic support sockets 33 for the bulbs 30. The sockets 33 are supported in recesses in L-shaped metal brackets 34. The reflectors 32 and L-shaped brackets 34 are secured to the metal backing plate 20 by rivets 36 (FIGS. 3 and 4).

The manually actuable switch 16 (FIGS. 1 and 3) is mounted in an aperture 38 (FIG. 3) in the metal cover 22. The switch 16 is connected to the halogen bulbs 30 of the lamp assemblies 14 for controlling the energization thereof. Preferably the switch 16 has a three-position rocker arm 40 (FIG. 3) that may be used to manually select OFF and two levels of brightness. A rectangular body 41 (FIG. 3) of the switch 16 incorporates a diode (not illustrated) which is switched in and out of the power circuit to divide the AC power delivered to the bulbs 30 in half, thereby achieving an inexpensive and reliable dimmer control. The body 41 of the switch 16 is mounted in a rectangular recess in a U-shaped metal bracket 42. The feet 42*a* of the metal bracket 42 snap into slots 20*a* (FIG. 4) in the backing plate 20. The backing plate 20 also has a pre-punched circular tab 20*b* (FIG. 4) which may be knocked out to allow ingress and egress of ROMEX (Trademark) AC wiring in lieu of the conventional power cord hereafter described having a plug for insertion into a standard duplex AC outlet.

The wiring of the light fixture 10 includes a conventional power cord 43*a* (FIG. 1) and wires 43*b* (FIG. 3) interconnecting the power cord 43*a* with the lamp sockets 33 and the circuit inside the body 41 of the rocker switch 16. A ground wire 43*c* is also provided for connecting a ground lead (not illustrated) of the power cord 43*a* to the metal backing plate 20. In FIG. 3 the ground wire 43*c* is shown unconnected at one end and secured to the base of a mounting bolt 48 that extends through the metal backing plate 20.

A heat shield 44 (FIG. 1) is located in an operative position overlying a control surface region 46 (FIG. 3) of the metal cover 22 surrounding the switch aperture 38. The heat shield 44 is sized and configured so that a user's fingers will not directly contact the warm control surface region 46 of the metal cover 22 when the switch 16 is actuated. The heat shield 44 reduces the amount of heat otherwise felt by the user when manually actuating the switch 16. It is preferably made of a high temperature resistant plastic that will not degrade or deform as a result of long term exposure to the heat generated by the adjacent halogen bulbs 30. The user accessible surface around the switch 16 thus becomes the upper side of the heat shield 44, which can be readily be kept under the sixty degrees C. maximum temperature of the applicable UL standard.

The control surface region 46 (FIG. 3) of the metal cover 22 may itself be sixty degrees C. or less. Thus it would meet the UL standard and not burn the user's fingers. However, it is still desirable to attach the heat shield 44. Otherwise the user may touch the very warm control surface region 46 and get the undesirable impression that the light fixture 10 is overheating and/or wasting energy.

The heat shield 44 (FIG. 3) is preferably removably attached to the metal cover 22 with the same bolt 48 and round nut 50 that hold the cover 22 to the metal backing plate 20 of the light fixture 10. The bolt 48 has a rear end secured to the backing plate 20 with a hex nut 51 and a threaded forward section extending through aligned holes 52 and 54 in the metal cover 22 and heat shield 44, respectively, as indicated by the long phantom line in FIG. 3. The knurled nut 50 is screwed over the threaded forward section of the bolt 48 and tightened against the heat shield 44.

Referring to FIGS. 5–8, the heat shield 44 has a main rectangular planar section 44*a* which overlies the control surface region 46 when the heat shield is in its operative position. The heat shield 44 further has a pair of minor rectangular planar sections 44*b* and 44*c* which extend perpendicularly from a pair of opposite side edges of the main planar section 44*a*. The minor planar sections 44*b* and 44*c* overlie a pair of opposite side walls 22*a* and 22*b* (FIG. 4) of the metal cover 22 when the heat shield 44 is in its operative position shown in FIG. 1. Thus the minor planar sections 44*b* and 44*c* serve to properly locate the heat shield 44 so that a switch aperture 55 (FIG. 3) in the heat shield 44 is aligned with the switch aperture 38 in the metal cover 22. This allows the rocker arm 40 of the switch 16 to extend through the heat shield 44 and be toggled by the user's finger tips. The heat shield 44 has a notch 44*d* (FIG. 5) aligned with a third aperture 56 (FIG. 3) in a side wall of the metal cover 22 through which the power cord 43*a* extends.

In an actual commercial embodiment of the present invention the heat shield 44 is molded out of clear LEXAN (Trademark) plastic with its planar sections 44*a*, 44*b* and 44*c* measuring approximately 0.03 inches in thickness. The main planar section 44*a* measures approximately 3.200 inches in length by approximately 2.020 inches in width. The minor planar sections 44*b* and 44*c* measure approximately 3.200 inches in length by approximately 0.970 inches in height. The inside radius of curvature where the main planar section 44*a* joins the minor planar sections 44*b* and 44*c* measures approximately 0.05 inches. The switch aperture 55 measures approximately 0.660 inches in length by approximately 0.900 inches in width. The hole 54 in the main planar section 44*a* has a diameter of approximately 0.160 inches and its center is approximately 0.300 inches from the end of the main planar section 44*a*.

Figure 9:
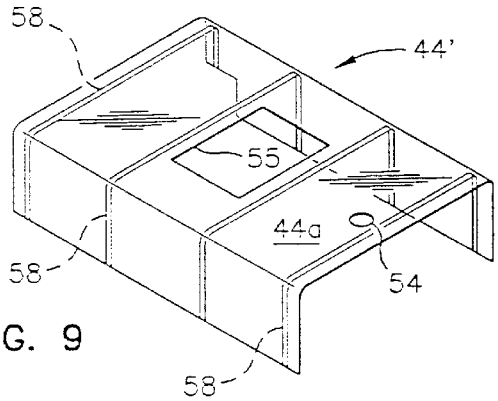
FIG. 9 is a greatly enlarged perspective view of a second embodiment of the heat shield of the present invention which incorporates ribs for enhancing airflow cooling.
Figure 10:
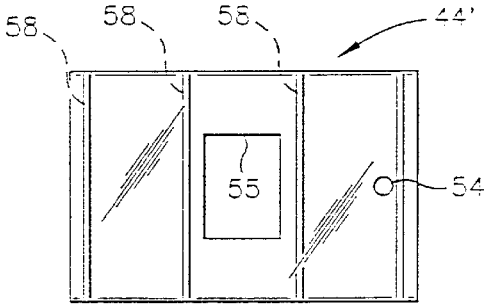
FIG. 10 is a top plan view of the second embodiment of my heat shield.
Figure 11:
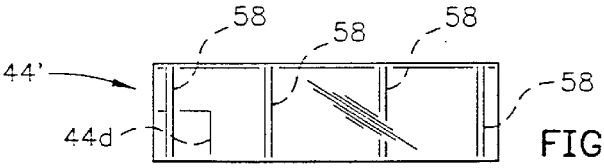
FIG. 11 is a side elevation view of the second embodiment of my heat shield.

Referring to FIGS. 9–11, in accordance with a second embodiment of my invention, a heat shield 44' includes a plurality of ribs 58 formed on an underside of each of the planar sections 44*a*, 44*b* and 44*c* for contacting the control surface region 46 of the metal cover 22. This defines a plurality of airflow gaps or channels through which air can flow by convection to enhance heat dissipation.

To recapitulate, the illustrated U-shaped plastic heat shield 44 is mounted over the control surface region 46 of the metal cover 22 of the halogen light fixture 10. The manually actuable control switch 16 is mounted in the cover 22 and extends through the apertures 38 and 55 in the cover 22 and heat shield 44, respectively, for turning the halogen bulbs 30 ON and OFF, and for dimming the same. The heat shield 44 is sized and configured so that a user's finger tips will not directly contact the metal cover 22 when the switch 16 is actuated. The heat shield 44 is removably attached to the cover 22 with the same bolt 48 and nut 50 that hold the metal cover 22 to the metal backing plate 20 of the light fixture 10. The heat shield 44 reduces the amount of heat otherwise felt by the user when manually actuating the switch 16.

While I have described a preferred embodiment of my low profile under cabinet halogen light bar, and two embodiments of a heat shield therefor, it will be understood by those skilled in the art that my invention may be modified in both arrangement and detail. For example, the housing need not be made of metal, and could, for example, be made of plastic. The heat shield need not have a U-shaped configuration. Other means for attaching the heat shield to the cover could be utilized such as screws, rivets, adhesive or the spring tension of the minor planar sections pressing against the side walls of the metal cover. The rocker switch could be replaced with a toggle switch, slide switch, push button switch, touch sensitive capacitive switch or any other form of UL approved switch commonly used in household light fixtures. The lamp assemblies shown which have sockets mounted to folded metal reflectors attached to the backing plate could be replaced with hockey puck style halogen lamp assemblies mounted in round openings formed in the cover. These and other changes and modifications to my invention will be readily apparent to designers of household light fixtures. Therefore, the protection afforded my invention should only be limited in accordance with the scope of the following claims.

We claim:

1. A light fixture, comprising:

a housing including a backing plate and a cover removably secured to the backing plate;

at least one halogen lamp assembly mounted in an interior of the housing for providing light through a first aperture in the cover while radiating a significant amount of heat that is absorbed by the cover;

a manually actuable switch mounted in a second aperture in the cover and connected to the lamp assembly for controlling the energization thereof;

a heat shield made of a material having a relatively low thermal conductivity located in an operative position overlying a control surface region of the cover surrounding the second aperture, the heat shield being sized and configured so that a user's fingers will not directly contact the cover when the switch is actuated; and means for attaching the heat shield to the cover in the operative position comprising a bolt having a rear end secured to the backing plate and a threaded forward section extending through aligned holes in the cover and heat shield, and a nut screwed over the threaded forward section of the bolt and tightened against the heat shield;

whereby the heat shield will reduce the the amount of heat otherwise felt by the user when manually actuating the switch.

2. In a light fixture having a housing including a backing plate and a metal cover removably secured to the backing plate, at least one halogen lamp assembly mounted in an interior of the housing for providing light through an aperture in the metal cover while radiating a significant amount of heat that is absorbed by the metal cover, and a manually actuable switch mounted to the metal cover and connected to the lamp assembly for controlling the energization thereof, the improvement comprising:

a heat shield made of a material having a relatively low thermal conductivity located in an operative position overlying a control surface region of the metal cover surrounding the switch, the heat shield being sized and configured so that a user's fingers will not directly contact the metal cover when the switch is actuated; and means for attaching the heat shield to the metal cover in the operative position comprising a bolt having a rear end secured to the backing plate and a threaded forward section extending through aligned holes in the metal cover and heat shield, and a nut screwed over the threaded forward section of the bolt and tightened against the heat shield;

whereby the shield will reduce the the amount of heat otherwise felt by the user when manually actuating the switch.

3. A light fixture, comprising:

a generally rectangular low profile metal housing including a backing plate and a cover removably secured to the backing plate;

at least one halogen lamp assembly mounted in an interior of the housing for providing light through a first aperture in the cover while radiating a significant amount of heat that is absorbed by the cover;

a manually actuable switch mounted in a second aperture in the cover and connected to the lamp assembly for controlling the energization thereof;

a heat shield made of a plastic material having a relatively low thermal conductivity located in an operative position overlying a control surface region of the metal cover surrounding the second aperture, the heat shield being sized and configured so that a user's fingers will not directly contact the metal cover when the switch is actuated, the heat shield having a main planar section which overlies the control surface region when the heat shield is in its operative position and a pair of minor planar sections which extend perpendicularly from a pair of opposite side edges of the main planar section and overly a pair of opposite side walls of the metal cover when the heat shield is in its operative position, and the main planar section of the heat shield having a switch aperture aligned with the second aperture in the metal cover through which a portion of the switch extends; and means for attaching the heat shield to the metal cover in the operative position including a bolt having a rear end secured to the backing plate and a threaded forward section extending through aligned holes in the metal cover and heat shield, and a nut screwed over the threaded forward section of the bolt and tightened against the heat shield;

whereby the heat shield will reduce the amount of heat otherwise felt by the user when manually actuating the switch.

4. A light fixture, comprising:

a housing including a backing plate and a cover removably secured to the backing plate;

at least one halogen lamp assembly mounted in an interior of the housing for providing light through a first aperture in the cover while radiating a significant amount of heat that is absorbed by the cover;

a manually actuable switch mounted in a second aperture in the cover and connected to the lamp assembly for controlling the energization thereof;

a heat shield made of a material having a relatively low thermal conductivity located in an operative position overlying a control surface region of the cover surrounding the second aperture, the heat shield being sized and configured so that a user's fingers will not directly contact the cover when the switch is actuated, the heat shield having a main planar section which overlies the control surface region when the heat shield is in its operative position and a pair of minor planar sections which extend perpendicularly from a pair of opposite side edges of the main planar section and overlie a pair of opposite side walls of the cover when the heat shield is in its operative position; and means for attaching the heat shield to the cover in the operative position;

whereby the heat shield will reduce the the amount of heat otherwise felt by the user when manually actuating the switch.

5. A light fixture according to claim 4 wherein the main planar section of the heat shield has a switch aperture aligned with the second aperture in the cover through which a portion of the switch extends.

6. A light fixture according to claim 4 wherein one of the minor sections of the heat shield has a notch aligned with a third aperture in a side wall of the cover through which a power cord extends.

7. A light fixture according to claim 4 wherein the heat shield includes a plurality of ribs formed on an underside of each of the planar sections for contacting the cover.

8. In a light fixture having a housing including a backing plate and a metal cover removably secured to the backing plate, at least one halogen lamp assembly mounted in an interior of the housing for providing light through an aperture in the metal cover while radiating a significant amount of heat that is absorbed by the metal cover, and a manually actuable switch mounted to the metal cover and connected to the lamp assembly for controlling the energization thereof, the improvement comprising:

a heat shield made of a material having a relatively low thermal conductivity located in an operative position overlying a control surface region of the metal cover surrounding the switch, the heat shield being sized and configured so that a user's fingers will not directly contact the metal cover when the switch is actuated, the heat shield having a main planar section which overlies the control surface region when the heat shield is in its operative position and a pair of minor planar sections which extend perpendicularly from a pair of opposite side edges of the main planar section and overlie a pair of opposite side walls of the metal cover when the heat shield is in its operative position; and means for attaching the heat shield to the metal cover in the operative position;

whereby the shield will reduce the the amount of heat otherwise felt by the user when manually actuating the switch.

9. A light fixture according to claim 8 wherein the main planar section of the heat shield has a switch aperture through which a portion of the switch extends.

10. A light fixture according to claim 8 wherein one of the minor sections of the heat shield has a notch through which a power cord extends.

11. A light fixture according to claim 8 wherein the heat shield includes a plurality of ribs formed on an underside of each of the planar sections for contacting the metal cover to define a plurality of airflow channels for enhancing heat dissipation.

* * * * *